United States Patent [19]

Haytayan

[11] 4,227,637

[45] Oct. 14, 1980

[54] PNEUMATIC FASTENING TOOL

[76] Inventor: Harry M. Haytayan, Sunnyside La., Lincoln, Mass. 01773

[21] Appl. No.: 964,955

[22] Filed: Nov. 30, 1978

[51] Int. Cl.[3] ..... B27F 7/02

[52] U.S. Cl. ..... 227/8; 227/32; 227/43; 227/113; 227/130

[58] Field of Search ..... 227/8, 9, 10, 11, 15, 227/16, 19, 31, 32, 35, 113, 130, 140, 48, 99, 112, 43

[56] References Cited

U.S. PATENT DOCUMENTS

| | | | |
|---|---|---|---|
| 3,368,730 | 2/1968 | Bayer | 227/140 X |
| 3,595,460 | 7/1971 | Pitkin | 227/48 |
| 3,854,536 | 12/1974 | Hallock, Jr. | 227/113 X |
| 4,040,554 | 8/1977 | Haytayan | 227/8 |

*Primary Examiner*—Paul A. Bell

*Attorney, Agent, or Firm*—Schiller & Pandiscio

[57] ABSTRACT

A pneumatic tool is disclosed for attaching small metal members such as washers and name tags to a workpiece. The tool generally comprises a pneumatic driver apparatus for driving nail-like fasteners and a holder apparatus for holding the metal member positioned before the driver so that the member may be engaged by a fastener as it leaves the tool and thereby fastened to a workpiece.

14 Claims, 8 Drawing Figures

PNEUMATIC FASTENING TOOL

BACKGROUND OF THE INVENTION

This invention relates to penumatic tools in general, and more particularly to a novel type of pneumatic fastening tool.

Pneumatic fastening tools per se are not new in the art. Various examples of such tools are shown in U.S. Pat. Nos. 4,040,554; 3,498,577; 3,905,535; 3,776,445; 3,512,454 and 3,708,096 and the references cited therein. These tools typically comprise a housing, a cylinder disposed in the housing, a piston slidably mounted in the cylinder, a hammer connected to the piston, means for causing the piston to reciprocate within the cylinder so as to drive the hammer from a first retracted position to a second extended position, and a nozzle section for receiving a fastener and positioning it for engagement with the hammer in order to permit the hammer to drive the fastener from the nozzle into a workpiece.

It is sometimes desired that the fastening tool be used to attach small metal parts or members such as washers or name tags to the workpiece. Those tools presently known to be in use generally require a tool operator to manually position the small metal member against the workpiece and hold it there by hand or some other means while he fastens it on. This fastening technique is acceptable for certain applications, but it can present problems, particularly when the member being attached is small in size (thereby making it difficult and dangerous to manually hold the member in place during fastening) or when the member being attached is a washer which has a small center hole to be penetrated and therefore requires critical fastening alignment. In addition, manual positioning of the member being attached may be impossible where the workpiece is very hot, such as when trying to attach a name tag to a newly cast steel ingot.

OBJECTS OF THE PRESENT INVENTION

As a result, one of the objects of the present invention is to provide a tool which allows an operator to place a small metal member such as a washer or name tag onto a holder on the front of the tool while the tool is safely withdrawn from a workpiece, and then bring the tool into engagement with the workpiece and effect fastening without the operator having to manually hold the metal member in position against the workpiece.

Another object is to provide a tool which utilizes a driver of the type disclosed in U.S. Pat. No. 4,040,554.

Still another object is to provide a tool which is adapted to attach a member to a very hot workpiece, such as a newly cast steel ingot, without the operator having to place his hand next to the workpiece, thereby reducing the risk of operator injury.

Another more specific object is to provide a fastening tool which (a) is adapted to support a part to be fastened, (b) is capable of securing that part to a workpiece by a fastener dispensed by a magazine carried by the tool, and (c) embodies control means which prevent it from driving a fastener until it is engaged with a workpiece.

SUMMARY OF THE PRESENT INVENTION

These and other objects of the present invention are addressed by providing a tool which generally comprises a pneumatic driver fitted with a part holder, where the driver preferably but not necessarily is a tool of the type disclosed in U.S. Pat. No. 4,040,554 and the part holder comprises a block or plate which is movably attached to the driver and is designed to hold the part to be fastened, e.g., a metal washer or name tag, in position for engagement with a fastener fired by the driver. Other features and advantages of the invention are disclosed by the following detailed description.

DESCRIPTION OF THE DRAWINGS

The following detailed description of the invention is to be considered together with the accompanying drawings wherein like numbers refer to like parts and further wherein.

DETAILED DESCRIPTION OF THE PRESENT INVENTION

Figure 1:
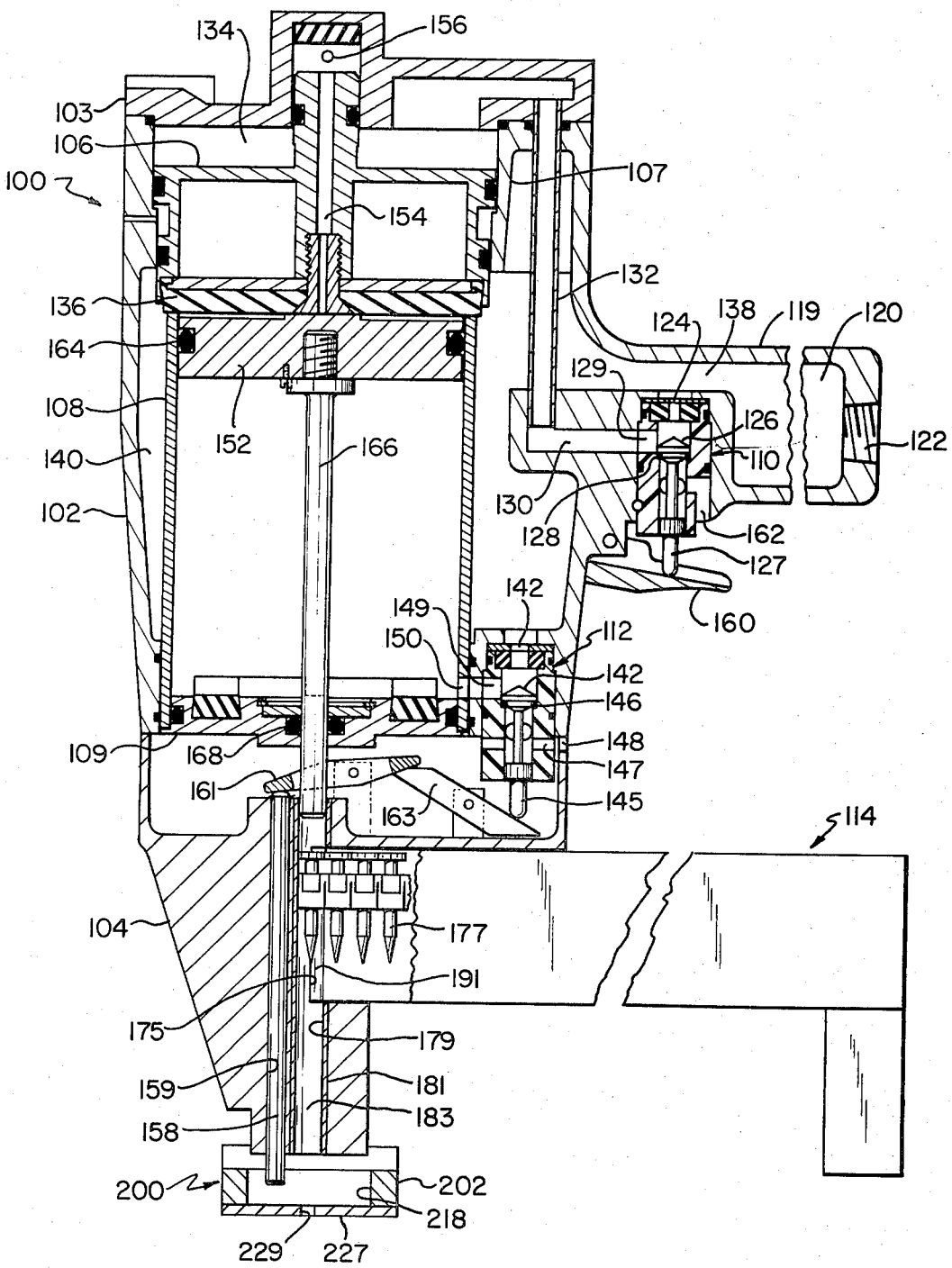
FIG. 1 is a sectional view in side elevation of one form of the present invention showing the pneumatic driver with its hammer in a retracted position and the part holder in an extended position.
Figure 2:
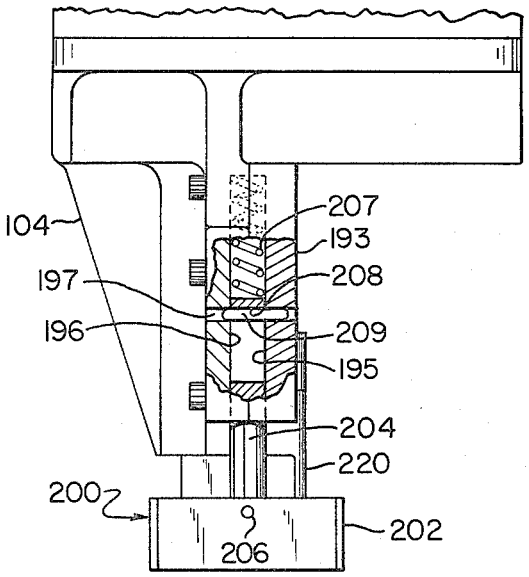
FIG. 2 is an enlarged partial side view in elevation showing the driver nozzle and the part holder of the device of FIG. 1, but with certain portions broken away and the fastener magazine removed.
Figure 3:
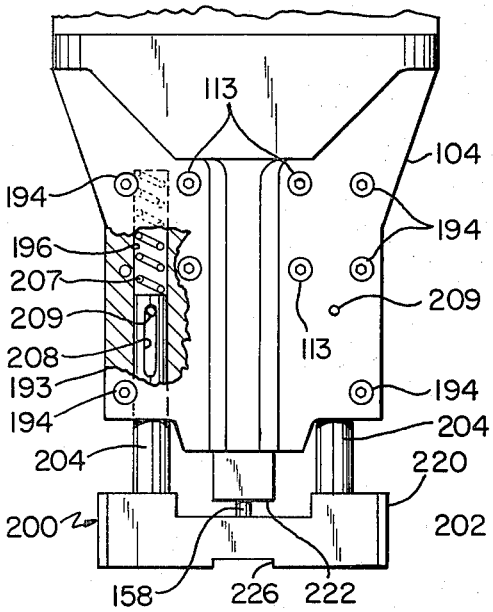
FIG. 3 is an enlarged front view in elevation showing the driver nozzle and the holder apparatus shown in FIG. 2.
Figure 6:
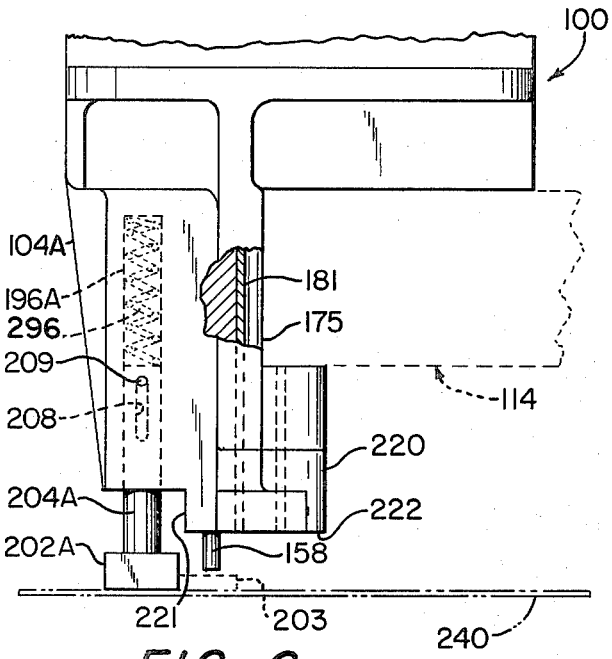
FIG. 6 is an enlarged partial side view in elevation showing a modified form of driver nozzle with a modified form of part holder.
Figure 7:
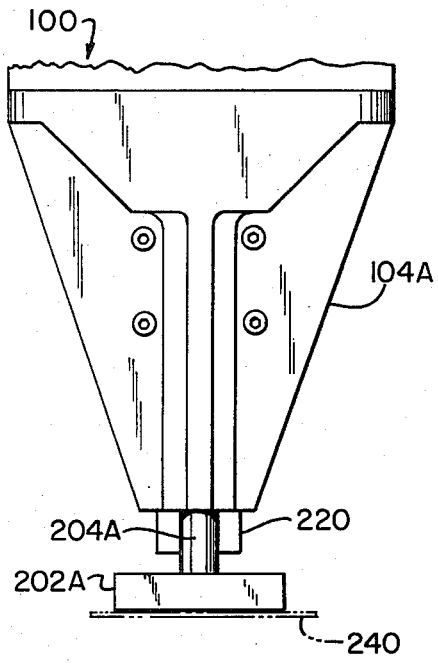
FIG. 7 is an enlarged front view in elevation showing the driver nozzle and part holder of FIG. 6.
Figure 8:
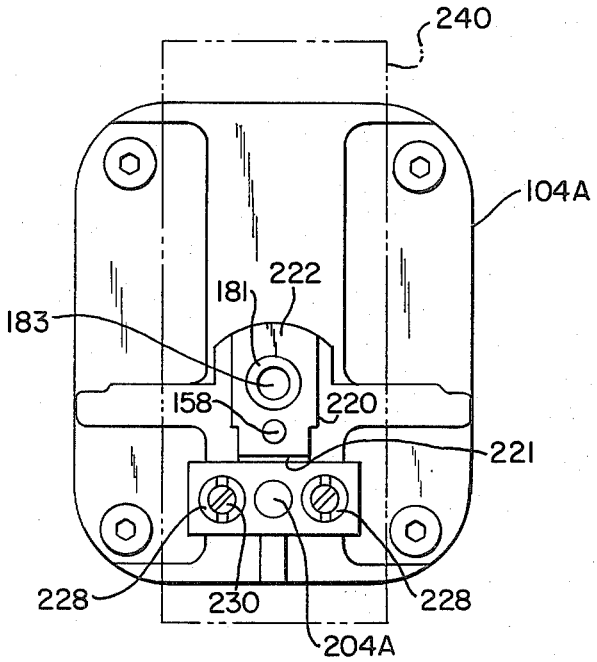
FIG. 8 is an enlarged bottom plan view of the driver nozzle and part holder of FIG. 6.

Referring first to FIG. 1, the fastener driving tool generally comprises a pneumatic driver 100 for driving fasteners supplied by a fastener magazine 114, and a part holder 200 for holding parts where they may be engaged by the fasteners and attached to a workpiece in the manner hereinafter described. It is to be appreciated that the holder apparatus 200 shown in FIG. 1–5 is specifically adapted for use with metal washers, and that the additional holder embodiment of FIGS. 6–8 is for use with metal parts of a different sort, such as metal name tags. The tool of FIGS. 1–5 has utility where it is desired to drive fasteners with flanged heads, e.g. common nails, into a workpiece with one or more washers captivated between the head of each fastener and the workpiece. An important specific application is in steel mills where a common practice is to use naillike fasteners to secure sheets of insulating material to the top ends of the inner surfaces of molds for casting steel ingots. It is desirable that a relatively large metal washer be mounted on each fastener as it is driven so as to provide a large area of engagement with the insulating sheets for better holding pressure and also to prevent the head of the nail from penetrating the insulating material.

The pneumatic driver 100 and the fastener magazine 114 shown in FIG. 1 are substantially the same as the corresponding mechanisms disclosed in U.S. Pat. No. 4,040,554, except that the nozzle of the driver has been modified to incorporate a part holder in accordance with the present invention. Accordingly, driver 100 and magazine 114 are described herein only to the extent believed necessary to understand and appreciate the present invention.

Referring first to FIG. 1, driver 100 generally comprises an outer housing 102 which has its upper and lower ends closed off by a cap member 103 and a nozzle 104 respectively. Housing 102 is formed so that one portion 107 coacts with cap 103 to define a poppet valve casing providing a chamber 134, and another portion 119 serves as a handle and also defines a manifold chamber 120. Housing 102 accommodates a poppet valve 106, a cylinder 108 closed off by an end wall 109, a piston 152 slidably disposed within cylinder 108, a hammer 166 attached to the piston and slidably extending through an opening in end wall 109, a control valve 110, and a safety valve 112. Valves 110 and 112 comprise valve members 126 and 144 attached to actuating rods 127 and 145 respectively, and a trigger 160 pivotally attached to housing 102 serves as a means for causing rod 127 to move valve member 126.

Fastener magazine 114 is mounted to nozzle 104. Nozzle 104 is formed with a bore 179 provided with a liner 181 and the lower end of hammer 166 extends into the hammer travel-way 183 defined by the liner. As explained below in connection with FIGS. 2–5, the nozzle is adapted to permit fasteners 177 to be admitted in single file into the hammer travel-way 183.

Other parts of the driver are described in connection with the following description of how it operates. First, pressurized air is supplied to manifold chamber 120 by connecting its inlet port 122 to a suitable supply of pressurized air, e.g. air at 150–175 psi. This air passes through an orifice 124 of valve 110 and acts on the valve head 126 to close off an opening defined by a valve seat 128 leading to a vent passageway 162. As a consequence the air passing through orifice 124 proceeds out of valve 110 via a side port 129, a passageway 130 and a tube 132 into a chamber 134 where it applies a force to the upper end of poppet valve 106, whereby the latter is urged to assume the position shown in FIG. 1 wherein a rubber disc 136 attached to its underside makes a tight seal with the upper end of cylinder 108. Simultaneously air is supplied by a passageway 138 to an air reservoir chamber 140 surrounding cylinder 108 and proceeds through an orifice 142 of safety valve 112 to urge its valve member 144 down so as to close off an opening defined by a valve seat 146 leading to one or more vent ports 147 that communicate with a vent opening 148 in the upper end of nozzle 104. As a consequence, the air entering the chamber of safety valve 112 also passes through a side port 149 and a passageway 150 into the interior of cylinder 108, thereby providing a force on the underside of piston 152 which holds the piston up against the sealing disc 136 of poppet valve member 106. Any air trapped between the upper end of the piston 152 and the disc 136 is exhausted to the atmosphere via a passageway 154 in the poppet valve and one or more vent ports 516 in cap 103. At this point the device is in a neutral, pressurized state.

Nozzle 104 pivotally supports two mutually engaging lever arms 161 and 163 and also has a bore 159 in which a safety rod 158 is slidably disposed. Rod 158 engages lever 161 and lever 163 engages an actuating rod 145 attached to valve head 144.

In order for the tool to fire, safety actuator rod 158 must be forced upwardly far enough to cause lever 163 to force rod 145 to lift valve member 144 sufficiently to unblock the opening in valve seat 146. If the triger 160 should be squeezed while rod 158 is in the down position shown in FIG. 1, valve member 126 will change positions and the air pressure acting on the upper side of the poppet valve 106 will be released by a discharge of air from chamber 134 via tube 132, the chamber in which valve member 126 is disposed, and valve port 162. As a result, the pressure in reservoir 140 will then move poppet valve 106 up and thereby allow pressurized air from the reservoir to act on the upper end of piston 152. However, no movement of the piston will occur because an equilibrium force condition exists as a result of the opposing force of the pressurized air acting on the bottom surface of piston 152 and the additional static frictional forces due to the engagement of piston seal 164 with the cylinder 108 and the rod-like hammer 166 with a stationary seal 168 carried by end wall 109. However, if safety actuator rod 158 is pushed far enough upwards so that valve member 144 now blocks off orifice 142, the air pressure acting on the underside of piston 152 will be rapidly exhausted to the atmosphere by outflow of air via passageway 150, side port 149, port 147 and opening 148. Hence if the trigger 160 should be squeezed so as to move the valve member 126 up far enough to close off orifice 124 while safety actuator rod 158 is held in its upward position, poppet valve 106 will move up rapidly in chamber 134 and the full line pressure in reservoir 140 will act on the upper end of piston 152 to cause the latter to move rapidly through its normal firing stroke so as to engage hammer 166 with a fastener 177 (advanced by magazine 114) and thereby drive it from the nozzle into a workpiece. The piston 152 will not return to its normal starting position (FIG. 1) until the actuator rod 158 and trigger 160 are both released. Then the driver will be ready to fire again, a new fastener having been automatically loaded into the firing chamber by the fastener magazine 114. In the preferred embodiment described and illustrated herein the safety actuator rod 158 is adapted to yield under about 10 pounds of pressure.

Figure 4:
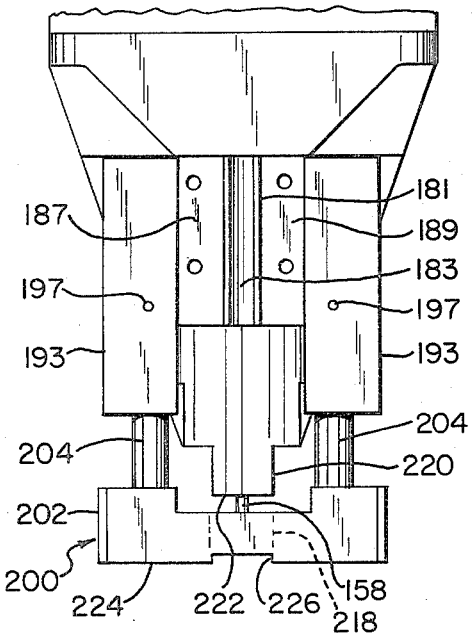
FIG. 4 is an enlarged rear view in elevation of the same nozzle and part holder as it appears without the fastener magazine.

Referring now to FIGS. 1–4, a portion of the nozzle is cut away as indicated at 175 in FIGS. 1 and 4 to a plane that bisects bore 179, whereby a portion of the bore 179 and the corresponding portion of liner 181 are semi-cylindrical and the remainder of the base and liner above and below the cutaway portion are cylindrical, and two flat co-planar surfaces 187 and 189 are formed on either side of and coextensive and even with the cut-away portion. The magazine 114 fits into the cut-away portion of nozzle 104 up against flat surfaces 187 and 189 and is held in place by suitable fasteners 113 (FIG. 3) which pass through holes in the nozzle and screw into tapped holes in the magazine. Although not shown, it is to be understood that the end of the magazine disposed in the cutaway portion of the nozzle is provided with flat surfaces that engage flat surfaces 187 and 189. In addition that same end of the magazine is provided with a discharge opening for nails and circularly curved surfaces as shown at 191 (FIG. 1) which have the same radius of curvature as passageway 183 and are located at appropriate sides of the nail discharge opening, whereby when the magazine is in place as shown in FIG. 1 the hammer passageway is fully cylindrical along its entire length except for where the magazine discharge opening is located.

Part holder 200 is mounted to nozzle 104 by means hereinafter described. As shown in FIGS. 1–4, holder 200 generally comprises a support block 202 which is mounted to a pair of rods 204. The lower ends of the rods 204 are received by blind holes formed in block 202 and are locked in place by dowel pins 206. The other end of rods 204 are slidably mounted to nozzle 104 by retainer members 193 which are secured to flat end surfaces 187 and 189 by screws 194. Each retainer is provided with a sem-icircular groove 195 which conforms and has the same diameter as a semi-cylindrical groove 196 formed in the confronting surface 187 or 189, so as to form a cylindrical slide passageway for each of the rods 204. A bore 197 is drilled through each retainer and the confronting portion of the nozzle at a right angle with and intersecting grooves 195 and 196 and each rod 204 is formed with a longitudinally elongate slot 208 which has a width somewhat greater than the diameter of bore 197. A roll pin 209 is force-fitted within each of the bores 197 so as to pass through the slot 208 formed in rod 204, whereby the length of the slots determines the length of travel of the parts holder relative to the nozzle.

The upper ends of rods 204 are engaged by compression springs 207 set into the blind holes formed by grooves 195 and 196, with the springs serving to urge block 202 away from nozzle 104 to the limit determined by pins 209 and slots 208. Slots 208 are sized and located so that when the pins 209 contact the upper ends of the slots and thereby act to stop block 202 in its outermost position relative to nozzle 104, safety mechanism actuator rod 158 will be fully extended so that its bottom end projects below the bottom end surface 222 of the nozzle.

A rectangular hole 218 is formed in support block 202. Hole 218 is aligned with but is made significantly larger than the hammer passageway 183, so that a fastener 177 discharged by the driver may pass through the hole 218 without interference from any part of the block. Hole 218 is sized large enough to permit the end of a rectangular extension 220 of nozzle 104 to pass therethrough when support block 202 is pushed upwardly toward the nozzle. Slots 208 are sized and positioned so that block 202 may be forced back towards the nozzle 104 at least far enough for the bottom end of control rod 158 in its extended position to be flush with the bottom surface 224. Preferably slots 208 are adapted to permit block 202 to be moved back far enough for the bottom surface 222 of extension 220 to be placed substantially flush with the bottom surface 224 of block 202. This is desirable since the safety rod 158 normally projects below the bottom surface 222 of nozzle extension 220. Thus it will be seen that when no pressure is applied to the bottom surface 224 of block 202, block 202 will be in its extended position (FIGS. 1–4) and the safety rod also will be fully extended. However, when a suitable back pressure, e.g., 10 psi, is applied to surface 224, block 202 will be forced back towards nozzle 104 far enough for nozzle extension 220 to project through hole 218 and surface 222 to become aligned with surface 224. Since safety mechanism actuator rod 158 normally projects from surface 222, this arrangement provides for actuating safety rod 158 by pressing block 202 against a workpiece in the manner hereinafter described.

Figure 5:
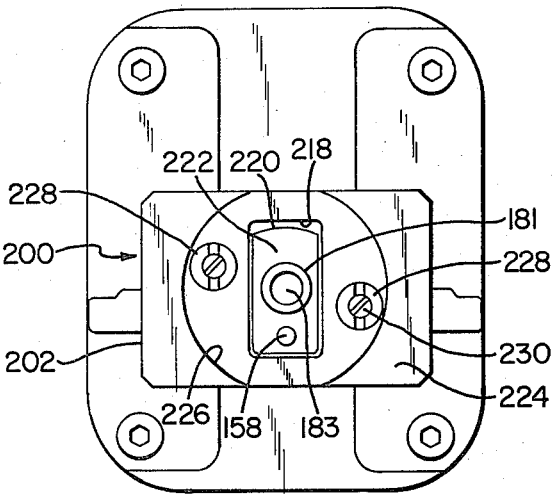
FIG. 5 is an enlarged bottom plan view of the same nozzle and part holder.

Referring now to FIGS. 1 and 5, block 202 has a circular depression or seat 226 which (a) is sized to receive a circular washer 227 (FIG. 1) so that the washer will make a somewhat loose fit with respect to the surrounding wall of the depression and (b) is located so that the center hole 229 of the washer will be substantially aligned with hammer passageway 183. The center hole of the washer preferably has a diameter that is slightly smaller than the maximum diameter of the shank of a fastener 177, so that when a fastener is discharged by the tool, its shank will make a frictional engagement with the washer as it penetrates the washer center hole and will carry it from its seat in support block 202 to the workpiece. Of course, the washer center hole diameter may be larger than the maximum shank diameter of the fastener, but in no case does it equal or exceed the diameter of the head of the fastener.

Washer 227 is releasably held in its seat 226 by means of one or more annular magnets 228 that are secured in holes formed in block 202 and are held in place by means of screws 230. Magnets 228 and the heads of screws 230 are flush with the base of depression 226 and serve to maintain a washer in its seat until a fastener passing from nozzle 181 engages the washer and carries it from the support block.

Operation of the tool will now be described. First an operator pressurizes the tool by coupling inlet port 122 to a regulated source of pressurized air, e.g. an air compressor. Then a fastener magazine 114 loaded with suitable fasteners is coupled to the tool and a washer 227 manually loaded into its seat in depression 226 (the fasteners preferably are supplied in strip form with each fastener being mounted to a separate plastic sleeve as disclosed in my U.S. Pat. No. 4,106,618, issued Aug. 15, 1978). At this point the tool is in the state shown in FIG. 1. Next the operator presses the tool against a flat workpiece with sufficient force to cause support block 202 to move towards nozzle 104 so that surface 222 becomes aligned with surface 224. As this is done, safety mechanism actuator rod 158 is engaged by washer 227 and forced into a retracted position, causing valve member 144 to lift off seat 146 and close off port 142. The shifting of valve head 144 causes the high pressure air beneath piston 152 to vent to the atmosphere via passageways 150 and 148. This places the tool in a state ready to fire. Now when the operator depresses trigger 160, valve member 126 lifts off seat 128 and causes the high pressure air in chamber 134 to vent to the atmosphere. This in turn causes the poppet valve 106 to move upward, bringing the full force of the pressurized air in chamber 140 to bear on the top of piston 152 and thereby cause the hammer 166 to move through its impact stroke and drive a fastener 177 from nozzle hole 183 into the workpiece. As fastener 177 emerges from nozzle hole 183 it passes through the hole 218 formed in block 202 and engages the washer 227 sitting in depression 226, thereby carrying the washer from the support block onto the workpiece where it is held in place by the head of the fastener. The recoil action of the hammer operation causes the tool to disengage itself from the workpiece, thereby allowing safety mechanism actuator rod 158 to return to its normal extended position. Upon release of trigger 160 the tool will recycle itself back to its normal ready state. After replacing the washer 227 with a fresh washer, the tool will once again be ready for use. This procedure may continue until the supply of fasteners in magazine 114 has been exhausted.

FIGS. 6–8 show another embodiment of the invention adapted for use in securing identification tags to articles. By way of example, the embodiment of FIGS. 6–8 may be used to attach to freshly molded steel ingots, metal tags that suitably identify the ingots, e.g., by composition, date of manufacture, customer order, etc. In this case the parts holder differs from that of the model of FIGS. 1–5 in that the parts support block 202A is supported by a single rod 204A and the nozzle 104A is formed with a blind hole 196A to slidably accommodate the single rod and a bore to accommodate a roll pin 209. The slide rod 204A has an elongated slot 208 and a roll pin 209 extends through the slot to limit the travel of rod 204A and block 202A. In this case rod 204A and support block 202A are displaced radially from the hammer passageway and also safety rod 158, as shown in FIG. 7. As with the embodiment of FIGS. 1–5, the nozzle is cut away as at 175 to accommodate a magazine (not shown). The nozzle also is cut away at 221 to avoid interference with support block 202A when the latter is pressed back toward the nozzle to the extent permitted by slot 208 and pin 209. The cutaway 221 is formed so that the support block can be forced back so that its bottom surface 224 is nearly flush with or preferably is above the bottom end surface 222 of nozzle extension 220. A spring 296 located in blind hole 196A urges support block 202A away from the nozzle and pin 209 and slot 208 permit the block to move down far enough for the bottom end surface 222 to sit beyond the bottom end of control rod 158, as shown in FIG. 6. The bottom side of support block 202A is flat but carries two flush-mounted magnets 228 located on opposite sides of slide rod 204A.

In practice a metal identification tag or name plate 240 is placed against the bottom surface of support block 202A so that it is held by the magnets and also so that it extends in the path of hammer passageway 183 and control rod 158. The tool is then manipulated so that the tag or plate 240 engages a work piece and then the tool is pressed toward the workpiece. This causes the support block to move toward the nozzle far enough for the tag or name plate to engage safety rod 158 and move it into the tool far enough to cause valve 112 to change states and prime the tool. If then the trigger is squeezed the tool will operate in the manner previously described so as to drive a fastener. The driven fastener will pierce the name plate or tag and then will penetrate the workpiece, with the result that the head of the fastener will secure the plate or tag to the workpiece.

Of course, the support blocks 202 and 202A could be arranged so that the safety rod is operated by engagement with them rather than by engagement with the part (e.g. washer 228 or name plate 240) to be driven. Thus, for example, support block 202A could have an extension 203 arranged to engage and depress safety rod 158 when the support block is moved back by the resistance offered by a workpiece.

A further possible modification is to have the work support block and/or the safety rod disposed so that the safety rod can be operated by the workpiece directly instead of via the work support blocks 202 and 202A or the part carried by the work support block. Thus, the safety rod could extend alongside of the part carried by the work support block and project beyond the bottom surface of the support block. For such a modification the work support block could be retractable as already described or it could be fixed relative to the nozzle. It also is to be understood that the driver may be of another design so long as is has a safety member located in or alongside its nozzle for preventing operation of the driver until the safety member is forced back by engagement of a workpiece with the safety member or the part support block. Other modifications of the invention will be obvious to persons skilled in the art.

What is claimed is:

1. Apparatus for holding and attaching parts to a workpiece comprising a driver and a parts holder attached to said driver;

said driver comprising a nozzle having an end surface and an internal hammer travelway terminating in an opening in said end surface, means including a side opening in said nozzle for positioning a fastener in said travelway, operating means for causing said hammer to move through a drive stroke and a return stroke along said travelway so that said hammer can drive a fastener out of said travelway via said opening, and safety means for preventing said operating means from causing said hammer to move through said drive stroke until said safety means is operated, said safety means comprising an actuating member in said nozzle and protruding from said end surface arranged to release said safety means when said actuating member is depressed;

said parts holder comprising a part support member located adjacent to and movably spaced apart from said end surface and adapted to support in the path of movement of said hammer and in adjacent and confronting relation with a workpiece a part intended to be fastened to said workpiece, and means carried by said nozzle for movably supporting said part support member for movement toward and away from said end surface of said nozzle so that when said part support member is positioned so that said part or said part support member is contacted with said workpiece said part support member may be moved toward said end surface a selected amount sufficient to cause said workpiece, said part support member or a part supported by said part support member to contact and depress said actuating member, whereby said driver may be operated to drive a fastener out of said hammer travelway into a workpiece with said fastener penetrating the part held by said part support member as it is discharged from said travelway.

2. Apparatus according to claim 1 further including spring means urging said part support member away from said nozzle.

3. Apparatus according to claim 1 wherein said part support member is supported by at least one slide rod slidably connected to said nozzle.

4. Apparatus according to claim 1 wherein said part support member comprises magnetic means for holding a part to be fastened made of metal.

5. Apparatus according to claim 1 wherein said part support member has an opening disposed in the path of said hammer, said opening being large enough so as not to interfere with movement of said hammer.

6. Apparatus according to claim 5 wherein said part support member comprises a side distal from said nozzle, said side having a depression for accommodating in predetermined alignment with said path of movement of said hammer a part to be fastened.

7. Apparatus according to claim 6 further including a magnet carried by said part support member for holding a part to be fastened.

8. Apparatus according to claim 7, wherein said part to be fastened is a washer made of steel and said depression is of circular shape and is disposed so as to surround said opening in said part support member.

9. Apparatus according to claim 6 wherein said opening in said part support member is formed large enough to accommodate said nozzle so that said end surface may be brought up flush against a part to be fastened disposed in said depression.

10. Apparatus according to claim 9 wherein said actuating member is disposed so that when said part support member is moved towards said nozzle said actuating member will contact and be depressed by a part to be fastened disposed in said depression.

11. Apparatus according to claim 1 wherein said driver comprises a piston attached to said hammer and a cylinder slidably containing said piston, and further wherein said operating means comprises means for selectively applying a high pressure gas to one side of said piston so as to urge said piston to move said through its drive stroke and means for removing high pressure gas from said one side of said piston so as to permit said piston to be moved through its return stroke, and said safety means comprises means for applying a high pressure gas to the other side of said piston so as to urge said piston to move through its return stroke and means for removing high pressure gas from said other side of said piston so as to permit said piston to be moved through its drive stroke.

12. Apparatus according to claim 11 wherein said operating means comprises a trigger operated control valve.

13. Apparatus according to claim 11 wherein said safety means comprises a safety valve operable by said actuating member.

14. Apparatus according to claim 13 wherein said actuating member is a rod slidably mounted in said nozzle and said operating means comprises a trigger operated control valve.

* * * * *

UNITED STATES PATENT AND TRADEMARK OFFICE

CERTIFICATE OF CORRECTION

PATENT NO. : 4227637

DATED : October 14, 1980

INVENTOR(S) : Harry M. Haytayan

It is certified that error appears in the above-identified patent and that said Letters Patent are hereby corrected as shown below:

Claim 11, column 9, line 14, the word "said" (second occurrence) should be deleted.

Signed and Sealed this

*Twenty-seventh* Day of *January 1981*

[SEAL]

*Attest:*

RENE D. TEGTMEYER

*Attesting Officer*

*Acting Commissioner of Patents and Trademarks*

UNITED STATES PATENT AND TRADEMARK OFFICE

CERTIFICATE OF CORRECTION

PATENT NO. : 4227637

DATED : October 14, 1980

INVENTOR(S) : Harry M. Haytayan

It is certified that error appears in the above-identified patent and that said Letters Patent are hereby corrected as shown below:

Claim 1, column 8, line 9, the phrase -- a hammer mounted for reciprocal movement along said travelway, -- should be inserted after the comma and before the term "operating".

Signed and Sealed this

*Fifteenth* Day of *February 1983*

[SEAL]

*Attest:*

GERALD J. MOSSINGHOFF

*Attesting Officer*

*Commissioner of Patents and Trademarks*